United States Patent [19]

Dahn et al.

[11] 4,231,293

[45] Nov. 4, 1980

[54] SUBMISSILE DISPOSAL SYSTEM

[75] Inventors: C. James Dahn, Chicago; Douglas R. Morita, Morton Grove; Allen J. Tulis, Addison, all of Ill.

[73] Assignee: The United States of America as represented by the Secretary of the Air Force, Washington, D.C.

[21] Appl. No.: 847,468

[22] Filed: Oct. 26, 1977

[51] Int. Cl.[3] ..... F42B 25/16

[52] U.S. Cl. ..... 102/7.2; 102/68

[58] Field of Search ..... 102/7.2, 68, 67, 37.6, 102/37.7, 34.4

[56] References Cited

U.S. PATENT DOCUMENTS

| | | | |
|---|---|---|---|
| 1,305,967 | 6/1919 | Hawks | 102/67 X |
| 2,304,060 | 12/1942 | Baylor | 102/68 |
| 2,604,043 | 7/1952 | Frisch et al. | 102/7.2 |
| 3,016,011 | 1/1962 | Brown | 102/7.2 |
| 3,611,931 | 10/1971 | Bessey et al. | 102/7.2 |
| 3,865,034 | 2/1975 | Boulter et al. | 102/7.2 |
| 3,956,990 | 5/1976 | Rowe | 102/67 X |
| 4,112,847 | 9/1978 | Thomanek | 102/67 |

FOREIGN PATENT DOCUMENTS

| | | | |
|---|---|---|---|
| 249765 | 4/1926 | United Kingdom | 102/68 |
| 764292 | 12/1956 | United Kingdom | 102/7.2 |

*Primary Examiner*—David H. Brown

*Attorney, Agent, or Firm*—Joseph E. Rusz; William J. O'Brien

[57] ABSTRACT

A system for dispersing submissiles from a cluster type weapons system comprising a multiplicity of hex-peaks cylindrical submissiles which have interstitial spaces between adjacent submissiles filled with a cylindrically shaped explosive charge.

2 Claims, 3 Drawing Figures

32
34
36
38
38
18
14
40
26
20
30
30
24
24
10
10
24
24
28
16
22
12
18

SUBMISSILE DISPOSAL SYSTEM

STATEMENT OF GOVERNMENT INTEREST

The invention described herein may be manufactured and used by or for the Government for governmental purposes without the payment of any royalty thereon.

BACKGROUND OF THE INVENTION

The invention relates to a system for dispersing submissiles. More particularly, this invention concerns itself with a system for dispersing explosive and non-explosive submunitions from a cluster bomb dispenser.

The recent interest in the tactical utilization of airborne cluster warheads has created a need for the development of a versatile system for rapidly dispersing submissiles packaged within a compact container. The efficient use of such a system requires a dispersion mechanism that is quick acting to as not to adversely effect the flight of the warhead and, simultaneously, is capable of producing a desired dispersion pattern within a target area. The system must also be versatile in allowing variations in the explosive formulation to provide different detonation velocity and the use of submissiles of differing size and number.

In attempting to satisfy the development needs referred to above, it was found that a system consisting of hex-packed cylindrical submissiles having interstitial spaces between adjacent submissiles filled with a dispersal explosive provided the desired solution. The dispersal explosive is prepackaged in sealed tubes complete with lead explosive. Since the tubes are of the same size as the interstitial space and in circumferential contact with adjacent submissiles, the maximum submissile packaging density is achieved. This provides a high dispersion velocity that makes the system particularly applicable for high terminal velocity, low level delivery to a target area. For example, a cylindrical warhead having a density of 18 inches, a length of 30 inches and closely packed with 540 cylindrical submissiles each 2 inches in diameter and 3 inches in length, achieved maximum submissile velocities of over 500 ft/sec with a near uniform ground spatial distribution.

SUMMARY OF THE INVENTION

The present invention concerns itself with a versatile system for the dispersal of explosive-filled submissiles from a cluster warhead using a low detonation velocity dispersal explosive positioned within the warhead in a predetermined manner. The explosive is prepackaged in a multiplicity of cylindrically shaped containers having their longitudinal axis in parallel relationship within the warhead container and a plurality of explosive or non-explosive cylindrically shaped submissiles having similar dimensions of said explosive container and circumferentially arranged about the explosive containers in abutting contact therewith such that said submissiles can be dispersed at maximum velocity with a near uniform ground spatial distribution within a given target area.

Accordingly, the primary object of this invention is to provide a system for rapidly dispersing submissiles from a cluster-type warhead or bomb.

Another object of this invention is to provide a system that utilizes a dispersal explosive to forcibly eject submissiles from a cluster-type warhead thereby eliminating any reliance on the aerodynamic force utilized in prior art dispersal systems.

Still another object of this invention is to provide a system for dispersing submissiles that possesses a high degree of versatility and flexability in the dispersal explosive formulation and submissile packaging density in order to achieve maximum velocities and target area distribution patterns.

A further object of this invention is to provide a dispersal system that utilizes cylindrical submissiles and cylindrical explosive dispersal containers in order to achieve maximum submissile packaging densities.

The above and still further objects and advantages of the present invention will become more readily apparent upon consideration of the following detailed description thereof when taken in conjunction with the accompanying drawings.

DESCRIPTION OF THE PREFERRED EMBODIMENTS

Figure 1:
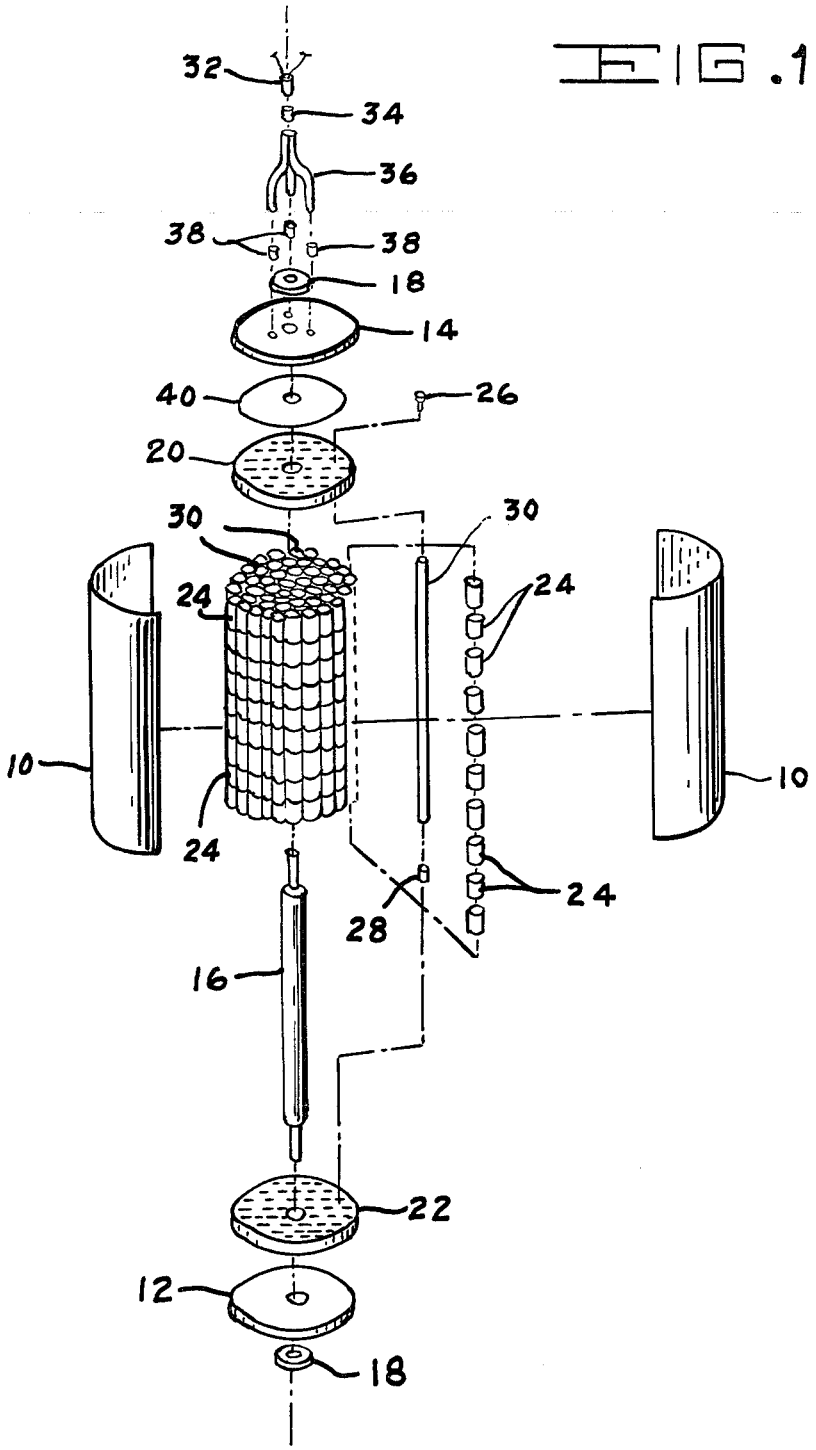
FIG. 1 represents a schematic illustration, in exploded form of a preferred embodiment of the submissile containing warhead of this invention.

Pursuant to the above-defined objects, this invention provides a novel system for effecting the rapid dispersion of submissiles from a cluster-type warhead or bomb. Basically, the dispersal system comprises a multiplicity of hex-packed cylindrical submissiles which have the interstitial spaces between adjacent submissiles filled with a dispersal explosive. The dispersal explosive is prepackaged into a sealed metal tube, complete with a lead explosive. Since the tubes are the same size as the interstitial space, a maximum submissile packaging density is achieved. The submissiles and dispersal explosive tubes are closely packed within a cylindrical container, for example, 18 inches in diameter by 30 inches long. The dispersal explosive may be packed in 0.25 inch inside diameter steel tubes which are inserted into the interstices between longitudinally aligned rows of submissiles or bomblets. An explosive train initiating system for initiating the dispersal explosive is also included. The submissiles, for example, are 2 inches in diameter by 3 inches in length, made of solid aluminum in the case of a non-explosive submissile, and weight 0.95 pounds. When tightly packed within the 18 inch diameter by 30 inch long cylindrical container, the submissiles 10 layers with 54 submissiles in each layer, and 84 interstices between rows of longitudinally aligned submissiles.

Dispersal explosives found to be effective for use with the clusters warhead of this invention are formulation 44 G, consisting of 5 percent by weight nitroguanadine and 95 percent by weight ammonium perchlorate and formulation 44 C which consists of 10 percent by weight nitroguanadine and 90 percent by weight of ammonium perchlorate. Other suitable explosives, however, may also be employed provided their detonation characteristics do not adversely affect the explosive submissiles upon their ejection and dispersion.

In order to further illustrate the invention, reference is made to the drawing wherein like reference characters indicate the same or similar elements. In FIG. 1, the structural element consists of a plexiglass cylindrical shell 10 shown in two sections in separated form. Two end plate assemblies 12 and 14, and a central steel support rod 16 with threaded ends and nuts 18 to hold the assembly together. Two mounting plates 20 and 22 have holes drilled at each of the interstitial spaces between rows of submissiles 24 to receive explosive lead caps 26 in plate 20 and end plugs 28 in plate 22 as shown by the dotted lines. The lead caps 26 and plugs 28 extend through their respective mounting plates to engage and align the dispersal explosive tubes 30 also as shown by the dotted lines.

The iniation system consists of a train of explosive elements arranged so that one firing signal will result in the initiation of detonation of each of the dispersal explosive tubes 30 contained in the warhead cylinder 10. The explosive train consists of a blasting cap 32, which initiates a tetryl pellet 34, which in turn initiates three strands of primacord 36. The detonation is in turn transmitted in three paths through the cover plate 14 by means of three tetryl pellets 38 to a disk of sheet explosive 40 sandwiched between the cover plate 14 and mounting plate 20. Detonation propagates through the sheet explosive simultaneously from the three initiation points, and as it does so, initiates the lead explosives 26 contained in the mounting plate 20. The lead explosive holders are aligned with the ends of the dispersal explosive tubes 30 and transmit the detonation to the explosive tubes 30. Detonation of the explosive tubes 30 bursts the warhead container 10 and deploys the submissiles 24.

A No. 8 blasting cap may be used as the detonator 32. Tetryl pellets, 0.15 inch in diameter by 0.25 inch in length may serve as the booster 34 while lengths of 150 grain Primacord 36 are used as the relay explosive. Comparable items, however, can be used interchangeably without affecting the initiation system function. Datasheet was chosen for the sheet explosive main relay charge 40 because it is a military qualified explosive (MIL-E-4667 Mu), it can be easily fabricated into the desired shape, and being in sheet form, it eliminates any necessity for developing a "printing circuit" type explosive network.

Tetryl and composition A4(RDX and wax) may be used for the lead explosive which is held in the lead explosive holders 26. These holders are engaged in one end of the explosive tubes 30, serving to seal that tube end and to hold the tube 30 in proper alignment with the sheet explosive 40. The other end is sealed with an end plug 28.

Figure 2:
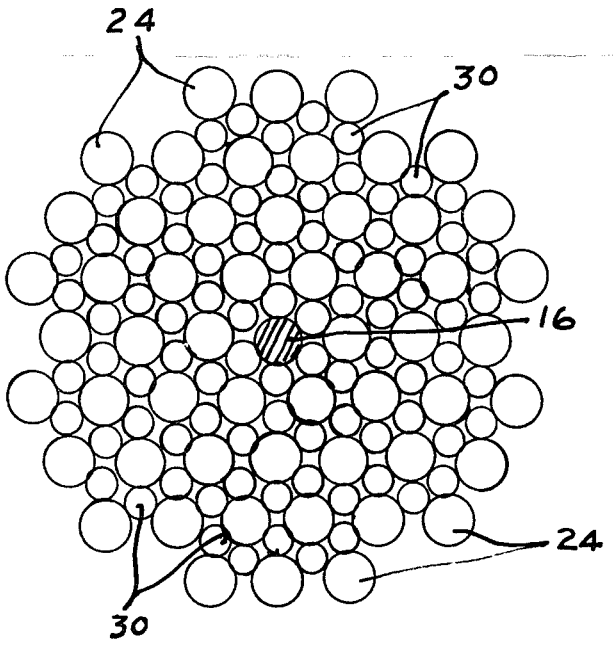
FIG. 2 represents a schematic illustration in exaggerated form, showing the packaging configuration of the warhead of FIG. 1.

FIG. 2 discloses in exaggerated form the arrangement of the submissiles 24 and explosive tubes 30 within a warhead container. In this configuration, there are eighty-four explosive tubes 30 having a length of 30 inches and containing explosive 44C. Ten layers of fifty-four submissiles 24 are also shown. In this particular instance the tubes 30 are exaggerated; but, in actuality, the submissiles 24 are touching each other. The rod provides central support for the submissiles 24 and tubes 30.

Figure 3:
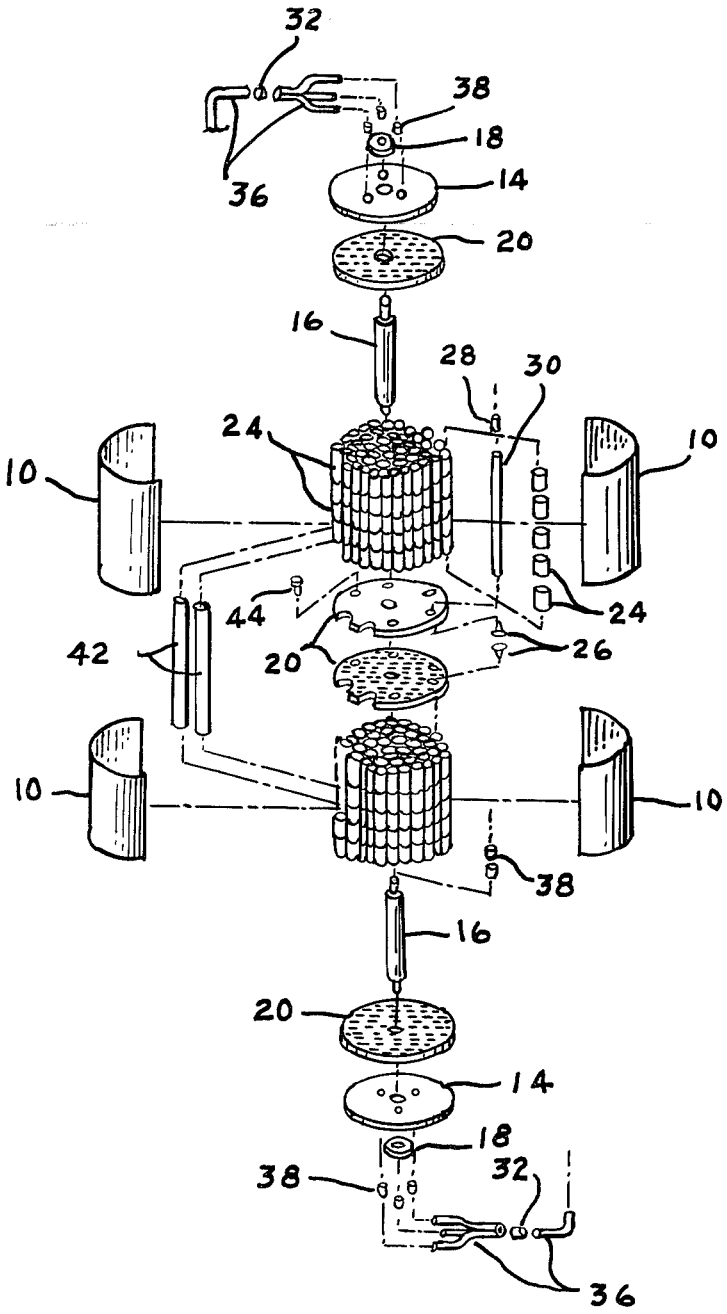
FIG. 3 represents a schematic illustration, in exploded form of an alternative embodiment of this invention.

FIG. 3 discloses an alternative design for the dispersal system of the invention which embodies a configuration similar to that of FIG. 1 except differing in that the warhead consists basically of two half-size warheads connected in tandom with initiation systems at both ends. Equal lengths of 100 grain Primacord 36 link the systems to the detonalog 32 for simultaneous initiation at both ends. This dual ignition system minimizes the dispersal angle of the submunitions. Also because of the applicability of the dispenser of FIG. 3 to long submissiles with a length to diameter ratio of approximately ten, two such submissiles 42 were included in this configuration. Each replaced six smaller submissile 24 in the outer row of one side of the warhead. The eighty-four explosive tubes 30 in both the top and bottom warhead halves were completely filled with explosive 44c at a density of 1.30 gm/ee. The end plate assemblies 14 at each end of the warhead are composed of Datasheet explosives in this configuration rather than being of metal construction as shown in FIG. 1. The submissiles may be filled with composition B explosive, if desired. Bolt 44 is utilized to hold the middle two mounting plates together.

While there has been described the fundamental features of this invention, it is to be understood that various alterations and embodiments to the invention can be made without departing from the spirit of the invention, the scope of which is defined by the appended claims.

What is claimed is:

1. A system for effecting the rapid and uniform dispersal of submissiles from a compact container, said system comprising A. a cylindrical container of frangible material having a support rod coaxially positioned therewithin;

B. a multiplicity of abutting cylindrically shaped submissiles oriented parallel to the longitudinal axis of said container and positioned around said support rod to substantially fill said container;

C. A multiplicity of cylindrical explosive charges interstitially located with respect to said submissiles to provide a hex-packed arrangement of said submissiles with respect to said support rod and said explosive charges with respect to said support rod; and D. means to initiate the detonation of said explosive charges in order to disperse said submissiles rapidly and uniformly over a predesignated target area.

2. A system in accordance with claim 1 wherein each of said multiplicity of submissiles is segmented to form a series of separate submissiles oriented in an end-abutting relationship.

* * * * *